US005790989A

United States Patent [19]

Chen

[11] Patent Number: 5,790,989

[45] Date of Patent: Aug. 11, 1998

[54] FOLDABLE HYGENIC PAD FOR TOILET SEAT

[76] Inventor: Shih-Chi Chen, P.O. Box 55-846, Taipei, Taiwan

[21] Appl. No.: 820,501

[22] Filed: Mar. 19, 1997

[51] Int. Cl.[6] ..... A47K 13/14

[52] U.S. Cl. ..... 4/245.1

[58] Field of Search ..... 4/245.1, 245.3, 4/245.4, 245.6, 245.7, 245.8

[56] References Cited

U.S. PATENT DOCUMENTS

| | | | |
|---|---|---|---|
| 747,960 | 12/1903 | Franken | 4/245.1 |
| 1,643,413 | 9/1927 | Mahoney | 4/245.6 |

FOREIGN PATENT DOCUMENTS

| | | | |
|---|---|---|---|
| 2501962 | 7/1976 | Germany | 4/245.1 |
| 0488744 | 7/1938 | United Kingdom | 4/245.7 |

*Primary Examiner*—Charles E. Phillips

[57] ABSTRACT

A hygienic pad for toilet seat includes: an upper layer made of soft, durable and flexible sheet material of annular shape, and a bottom layer having a plurality of sector members made of materials having suitable coefficient of friction to be frictionally held on a toilet seat and secured to a bottom surface of the upper layer, whereby upon folding of the plurality of sector members of the bottom layer to be concealed in the upper layer, the hygienic pad will be folded, and stored for convenient reuse without contacting a bottom surface of the bottom layer which may be contaminated by dirts in the toilet.

2 Claims, 4 Drawing Sheets

FOLDABLE HYGENIC PAD FOR TOILET SEAT

BACKGROUND OF THE INVENTION

U.S. Pat. No. 3,348,243 to W. S. Kelly disclosed sanitary single-use toilet seat cover including a base and a stack of sanitary toilet seat covers detachably secured thereon, one of which may be readily removed from the base everytime the toilet seat is used.

However, this prior art may have the following drawbacks:

1. A plurality of toilet seat covers are stacked on the base, possibly being contaminated by urine or other pollutants in the toilet.

2. Each seat cover is provided for a single use, not reusable and thereby wasting materials for such toilet seat covers.

3. Even the used toilet seat cover is disposable for sanitary purpose, so many disposed seat covers may increase the treatment problem on the viewpoint of environmental protection.

The present inventor has found the drawbacks of the conventional toilet seat covers and invented the present hygienic pad for toilet seat which is foldable and reusable.

SUMMARY OF THE INVENTION

The object of the present invention is to provide a hygienic pad for toilet seat including: an upper layer made of soft, durable and flexible sheet material of annular shape, and a bottom layer having a plurality of sector members made of materials having suitable coefficient of friction to be frictionally held on a toilet seat and secured to a bottom surface of the upper layer, whereby upon folding of the plurality of sector members of the bottom layer to be concealed in the upper layer, the hygienic pad will be folded, and stored for convenient reuse without contacting a bottom surface of the bottom layer which may be contaminated by dirts in the toilet.

DETAILED DESCRIPTION

Figure 1:
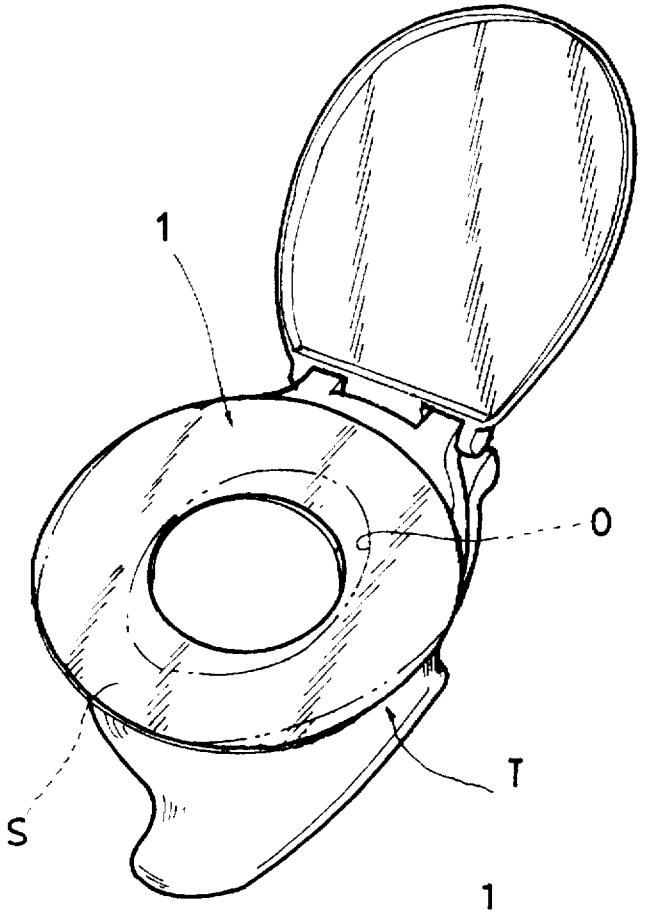
FIG. 1 is a perspective view of the present invention when adhered on a toilet seat.
Figure 2:
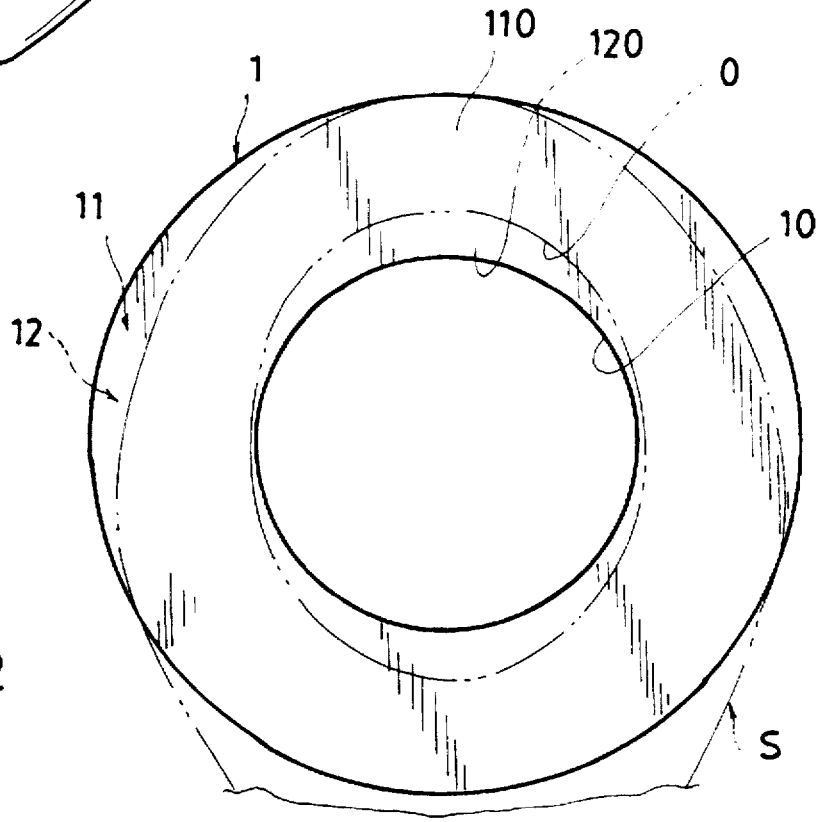
FIG. 2 is a top view of the present invention.
Figure 3:
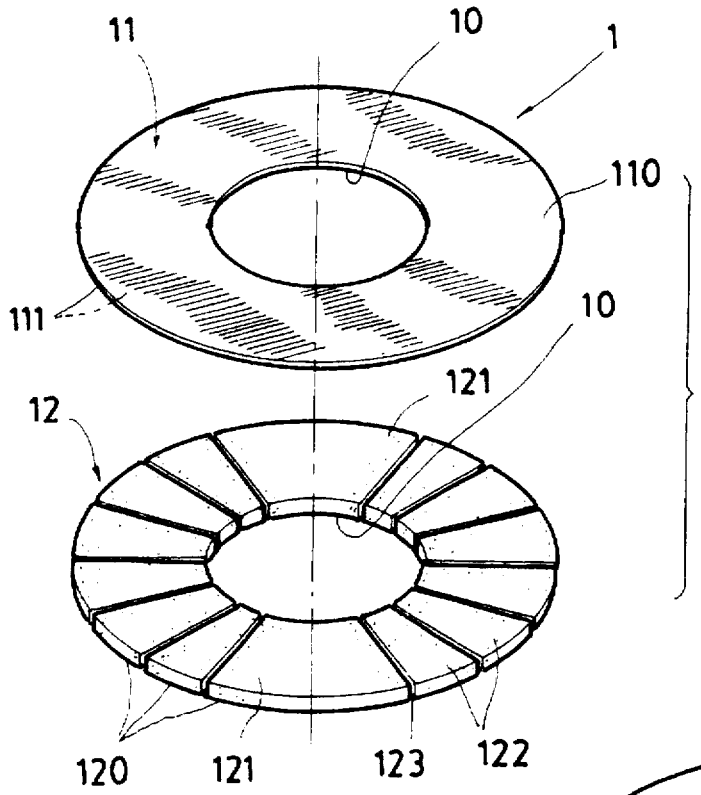
FIG. 3 is an exploded view showing two elements in construction of the present invention.
Figure 4:
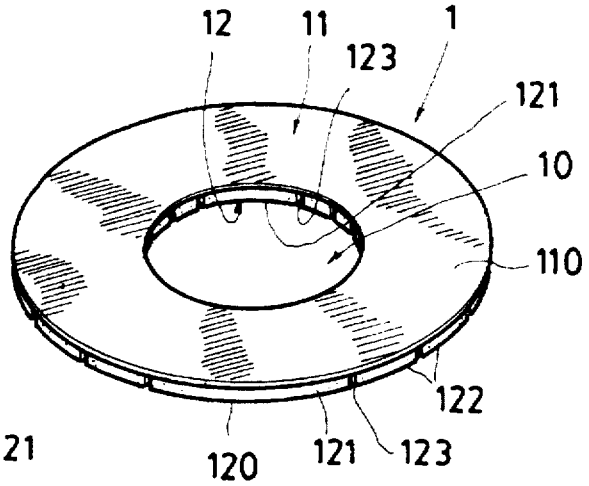
FIG. 4 is a perspective view of the present invention when assembled.

As shown in the drawing figures, a preferred embodiment of the hygienic pad 1 for toilet seat of the present invention comprises: an upper layer 11 made of soft durable and flexible materials and a bottom layer 12 made of materials having suitable coefficient of friction (such as rubber or other elastomers) to be frictionally adhered on a toilet seat S formed on a toilet bowl T, with a central circular opening 10 formed in a central portion of the hygienic pad 1 to be corresponding to an opening 0 formed in the toilet seat S. The pad 1 shall be sterilized and performed with antibacterial treatment.

The upper layer 11 is formed as an annular shape having a central circular opening 10, a top seating surface 110 adapted to be seated by a user's body portion such as his or her hip (not shown), and a bottom surface 111 opposite to the top seating surface 110 to be secured with the bottom layer 12.

The bottom layer 12 defining a central circular opening 10 includes: a pair of main sector members 121 diametrically disposed on two opposite sides of an abscissa X of the hygienic pad 1, a plurality of pairs of semi sector members 122 symmetrically disposed on two opposite sides of an ordinate Y perpendicularly intersecting the abscissa X at a center C of the pad 1, with every two neighboring sector members 121, 122 having a radial aperture 123 defined therebetween for forming a folding line when folding the sector members 121, 122, and the semi sector members 122 foldably sandwiched in between the two main sector members 121 when folded, and with the bottom layer 12 having a bottom adhesion surface 120 on a bottom of the bottom layer 12 to be frictionally adhered on the toilet seat S for a stable seating of a user on the toilet seat S when using the toilet.

The area of each main sector member 121 is two times of the area of each semi sector member 122.

All the sector members 121, 122 are adhered or joined by any conventional methods to the bottom surface 111 of the upper layer 11.

The number and area of each sector members 121, 122 may be calculated or designed as described hereinafter:

By designating the total area of the annularly shaped hygienic pad 1 to be A, there are two main sector members 121 each having an area of $A \cdot 2/m$, where m is obtained by the following formula: $m=4n+4$ wherein m is a variable having to do with n which is an integer of 1, 2, 3, 4, . . . etc.

And the number of the semi sector members 122 is $(m-4)$, each semi sector member 122 having an area of: $A \cdot 1/m$, wherein the m is obtained from the aforementioned formula, namely, $m=4n+4$.

Figure 5:
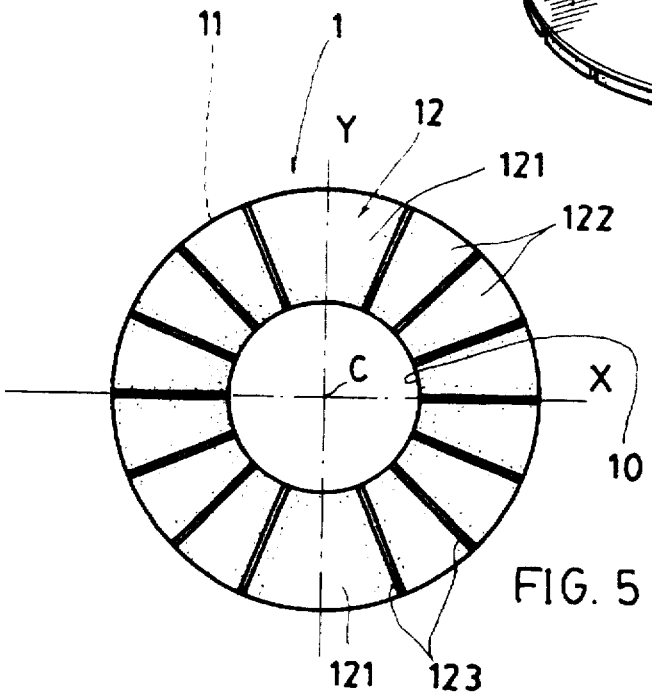
FIG. 5 is a bottom view of the present invention.

As shown in FIG. 5, the integer n is designated as 3 (n=3), then the variable m is obtained as follows:

$$m=4n+4=4\times3+4=16$$

So, each main sector member 121 has an area of $A \cdot 2/m = A \cdot 2/16 = A/8$ (one eighth of the total area A of the pad 1); and each semi sector member 122 has an area of $A \cdot 1/m = A \cdot 1/16 = A/16$ (one sixteenth of the total area A of the pad 1).

Figure 6:
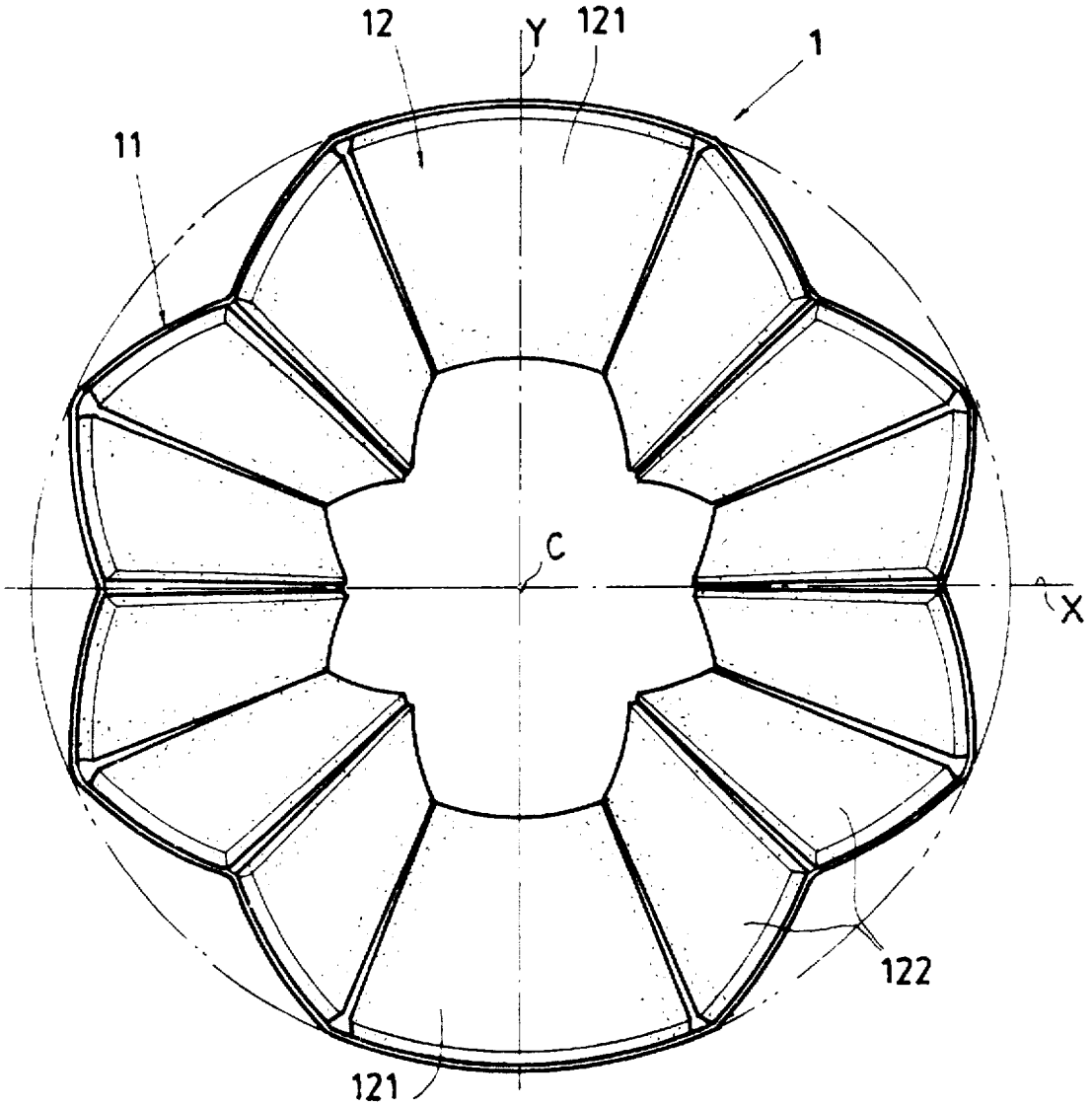
FIG. 6 is a perspective view showing an initiative step when folding the pad of the present invention.
Figure 7:
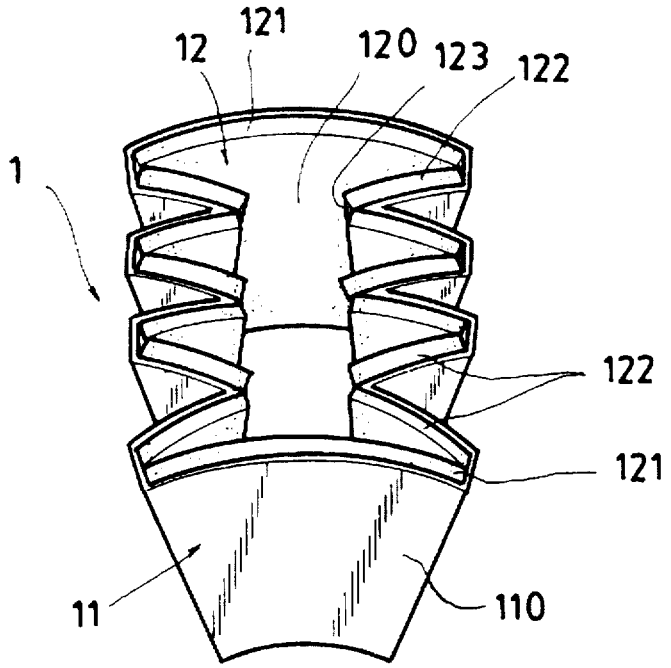
FIG. 7 shows a second step when folding the pad of the present invention after FIG. 6.
Figure 8:
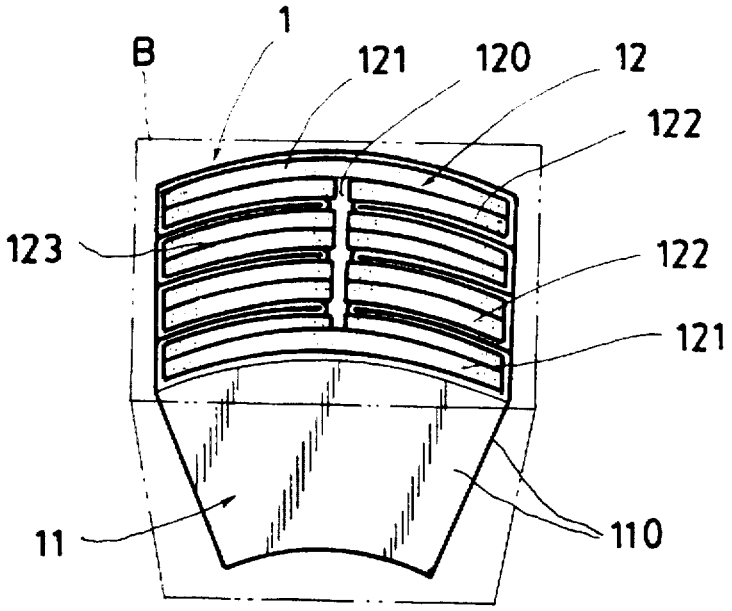
FIG. 8 shows a folded pad of the present invention.

When folding the pad 1 as shown in FIGS. 6–8, the semi sector members 122 are foldably sandwiched in between the two main sector members 121 and disposed inside the upper layer 11 to have a folded compact volume to be stored in a bag B for convenient portable reuse.

Since the bottom adhesion surface 120 of the bottom layer 12, which may be possibly contaminated as formed on the bottom side of the bottom layer 12, is folded and "concealed" inside the upper layer 11, the folded pad 1 can be carried without contacting the bottom surface 120 of the bottom layer 12 for hygienic purpose for preventing contamination or infection by bacteria or virus.

The number of sector members 121, 122 are not limited in the present invention.

The present invention is superior to conventional toilet seat covers such as disclosed in U.S. Pat. No. 3,348,243 with the following advantages:

1. The hygienic pad 1 is foldable and can be reused for better environmental protection and for saving money.

2. The hygienic pad 1 may be a personal belonging and may be kepted in a personal bag or case for a nice hygienic management.

3. The pad 1, once being folded to a compact unit, will be conveniently stored and handled especially beneficial for travelling or for portable uses in public places.

The present invention may be modified without departing from the spirit and scope of this invention.

I claim:

1. A foldable hygienic pad for toilet seat comprising:

an upper layer made of soft durable flexible materials having an annular shape with a central circular opening formed therein to be corresponding to an opening formed in a toilet seat rested on a toilet bowl; and a bottom layer having a shape corresponding to said upper layer and including a plurality of sector members secured to a bottom surface of said upper layer, said bottom layer made of materials having a coefficient of friction adapted to be frictionally held on the toilet seat, whereby upon folding of said sector members of the bottom layer to be concealed inside the upper layer, the pad will be folded and stored for preventing contacting of the bottom layer which is subjected to contamination by dirts in a toilet;

said bottom layer including: a pair of said main sector members diametrically disposed on two opposite sides of an abscissa of the hygienic pad, a plurality of pairs of semi sector members symmetrically disposed on two opposite sides of an ordinate perpendicularly intersecting the abscissa at a center of the pad, with every two neighboring sector members having a radial aperture defined therebetween for forming a folding line when folding the sector members, and said semi sector members foldably sandwiched in between the two main sector members when folding said pad.

2. A foldable hygienic pad according to claim 1, wherein said hygienic pad has a total area of A, each said main sector member having an area of $A \cdot 2/m$, where m is obtained by the following formula: $m=4n+4$ wherein m is a variable with respect to the n which is an integer, and the number of said semi sector members is $(m-4)$, each said semi sector member having an area of: $A \cdot 1/m$.

* * * * *